US012559905B2

(12) United States Patent
Horii

(10) Patent No.: US 12,559,905 B2
(45) Date of Patent: Feb. 24, 2026

(54) WORKING MACHINE

(71) Applicant: KUBOTA CORPORATION, Osaka (JP)

(72) Inventor: Hiroshi Horii, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 535 days.

(21) Appl. No.: 18/079,570

(22) Filed: Dec. 12, 2022

(65) Prior Publication Data

US 2023/0106216 A1 Apr. 6, 2023

Related U.S. Application Data

(63) Continuation of application No. PCT/JP2021/048009, filed on Dec. 23, 2021.

(30) Foreign Application Priority Data

Jan. 27, 2021 (JP) ..... 2021-011435

(51) Int. Cl.
*E02F 9/20* (2006.01)
*E02F 9/16* (2006.01)
*E02F 9/22* (2006.01)

(52) U.S. Cl.
CPC ..... *E02F 9/2004* (2013.01); *E02F 9/16* (2013.01); *E02F 9/2267* (2013.01)

(58) Field of Classification Search
CPC ..... E02F 9/2004; E02F 9/16; E02F 9/2267; E02F 9/2012; E02F 3/325; G05G 1/01; G05G 5/28
See application file for complete search history.

(56) References Cited

U.S. PATENT DOCUMENTS 7,389,845 B2 * 6/2008 Longueville ..... B60N 2/777 180/326
9,033,002 B2 5/2015 Kato et al.
(Continued)

FOREIGN PATENT DOCUMENTS

JP 3-206216 A 9/1991
JP 2004 124544 A 4/2004
(Continued)

OTHER PUBLICATIONS

European Search Report that issued in corresponding European Patent Application No. 21923250.1, dated Nov. 19, 2024.
(Continued)

*Primary Examiner* — Peter D Nolan
(74) *Attorney, Agent, or Firm* — GREENBLUM & BERNSTEIN, P.L.C.

(57) ABSTRACT

A working machine includes: an operating body switchable between a first position to prevent an operator from getting on/off an operator's seat and a second position to allow the same; a plurality of hydraulic actuators whose operation is enabled when the operating body is in the first position and disabled when in the second position; a manipulation member to be manipulated to operate the hydraulic actuators; and a pattern switching member to be operated switchingly to select one from among a plurality of manipulation patterns of the manipulation member to operate the hydraulic actuators. When the operating body is in the first position, at least a part of the pattern switching member is covered by the operating body so that the pattern switching member is impossible or difficult to be operated. When the operating body is in the second position, the pattern switching member is exposed to be operable.

5 Claims, 15 Drawing Sheets

(56) References Cited

U.S. PATENT DOCUMENTS

| | | | | |
|---|---|---|---|---|
| 2008/0035401 | A1* | 2/2008 | Ishii | E02F 9/0866 137/625 |
| 2014/0034160 | A1* | 2/2014 | Kato | G05G 5/06 137/561 R |
| 2019/0389519 | A1* | 12/2019 | Bergsten | B62D 49/0692 |

FOREIGN PATENT DOCUMENTS

| | | | | |
|---|---|---|---|---|
| JP | 2009 024395 | A | 2/2009 | |
| JP | 4758400 | B2 * | 8/2011 | E02F 9/2012 |
| JP | 2014 032462 | A | 2/2014 | |
| JP | 2018 053521 | A | 4/2018 | |
| KR | 2010 0074796 | A | 7/2010 | |

OTHER PUBLICATIONS

Official Communication issued in International Bureau of WIPO Patent Application No. PCT/JP2021/048009, dated Feb. 8, 2022, along with an English translation thereof.

* cited by examiner

WORKING MACHINE

CROSS REFERENCE TO RELATED APPLICATIONS

This application is a continuation application of International Application No. PCT/JP2021/048009, filed on Dec. 23, 2021, which claims the benefit of priority to Japanese Patent Application No. 2021-011435, filed on Jan. 27, 2021. The entire contents of this application are hereby incorporated herein by reference.

BACKGROUND OF THE INVENTION

1. Field of the Invention

The present invention relates to a working machine such as a backhoe.

2. Description of the Related Art

A working machine disclosed in Japanese Unexamined Patent Application Publication No. 2014-032462 is known in the art. In the working machine disclosed in Japanese Unexamined Patent Application Publication No. 2014-032462, an operating body is provided beside an operator's seat. The operating body includes a manipulator base on which a manipulation member to be manipulated to operate a plurality of hydraulic actuators is mounted. The operating body is configured to be switchable between a first position to prevent an operator from getting on/off an operator's seat and a second position to allow the operator to get on/off the operator's seat. The operation of the plurality of hydraulic actuators is enabled when the operating body is in the first position. The operation of the plurality of hydraulic actuators is disabled when the operating body is in the second position.

Its machine body is equipped with a pattern switching member operable for switching the manipulation pattern of the manipulation member for the plurality of hydraulic actuators among a plurality of manipulation patterns.

SUMMARY OF THE INVENTION

As for a method of operating the pattern switching member, it is recommended that the pattern switching member should be operated when the operating body is in the second position. However, in the working machine according to related art, undesirably, the pattern switching member is operable even when the operating body is in the first position. In light of the above problem, the present invention aims to provide a working machine capable of preventing its pattern switching member from being operated in a state in which its operating body is in the first position.

A working machine according to a certain aspect of the present invention includes: a machine body; an operator's seat mounted on the machine body; an operating body provided in proximity to the operator's seat and switchable between a first position and a second position, the first position being a position to prevent an operator from getting on and off the operator's seat, the second position being a position to allow the operator to get on and off the operator's seat; a plurality of hydraulic actuators whose operation is enabled when the operating body is in the first position and whose operation is disabled when the operating body is in the second position; a manipulation member to be manipulated to operate the plurality of hydraulic actuators; and a pattern switching member to be operated switchingly to select one from among a plurality of manipulation patterns of the manipulation member to operate the plurality of hydraulic actuators, wherein when the operating body is in the first position, at least a part of the pattern switching member is covered by the operating body so that the pattern switching member is impossible or difficult to be operated, and when the operating body is in the second position, the pattern switching member is exposed to be operable.

The working machine may further include: a plurality of control valves provided correspondingly for the plurality of hydraulic actuators and configured to hydraulically control the plurality of hydraulic actuators respectively; a detection sensor configured to detect a manipulating direction and a manipulation amount of the manipulation member; and a controller configured to acquire a detection signal from the detection sensor and electrically control the control valves. The pattern switching member may be configured as a switch that has switching operation positions corresponding to the respective manipulation patterns and sends a switching operation signal corresponding to one of the switching operation positions to the controller. The controller may include a pattern switch configured to, based on the switching operation signal sent from the pattern switching member, switch the manipulation pattern.

The operating body may include a manipulator base disposed beside the operator's seat. The manipulation member may be mounted on the manipulator base. The manipulator base may include a manipulator base cover covering a supporting structure body of the manipulator base and having an open-bottomed shape. When the operating body is in the first position, the pattern switching member may be located inside an area of, and closer to a lower end of, the manipulator base cover, and at least a top portion of the pattern switching member may be located above a lower end of a wall portion of the manipulator base cover covering a front of the pattern switching member and above a lower end of a wall portion of the manipulator base cover covering a side of the pattern switching member. The working machine may further include: a seat table supporting the operator's seat, wherein a rear portion of the manipulator base may be pivotally supported by the seat table such that a front portion of the manipulator base is configured to move pivotally up and down, and the manipulator base may be configured to switch to the second position by being moved pivotally up from the first position, which is closer to the seat table, and the pattern switching member may be disposed on the seat table under the front portion of the manipulator base.

The pattern switching member having switching operation positions corresponding to the respective manipulation patterns may be disposed at a position where at least one of the switching operation positions is visible through a clearance between the operator's seat and the manipulator base when the operating body is in the first position. The manipulator base cover may have a side opening portion, which is open toward the operator's seat and located behind a portion having a wall facing toward the operator's seat, and the pattern switching member may be located behind a front edge of the side opening portion such that the at least one of the switching operation positions corresponding to the respective manipulation patterns is visible through the side opening portion.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
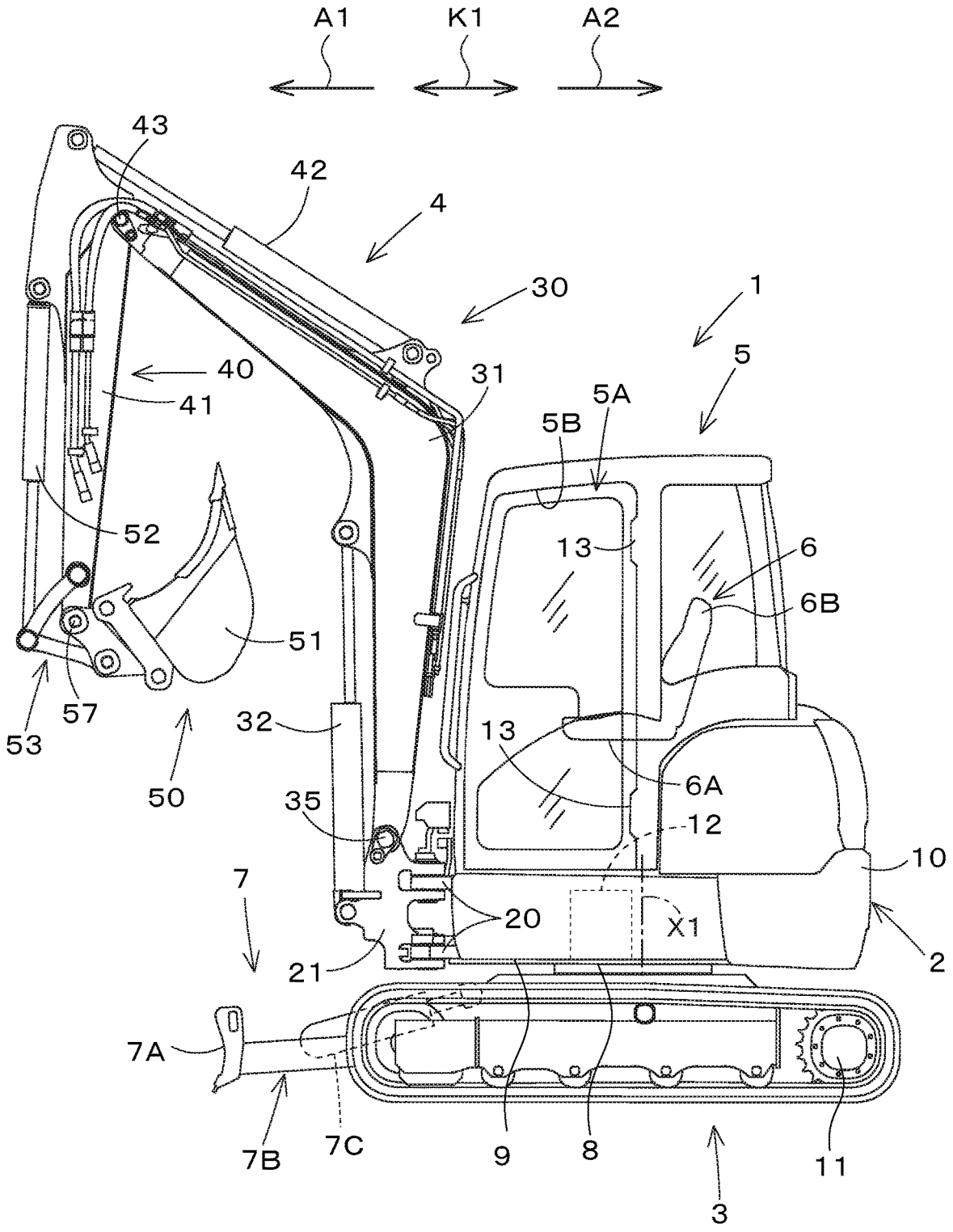
FIG. 1 is a side view of a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

A certain embodiment of the present invention will now be described while referring to the drawings, where necessary. FIG. 1 is a schematic side view illustrating the overall structure of a working machine 1 according to the present embodiment. In the present embodiment, a backhoe, which is a swiveling working machine, will be taken as an example of the working machine 1. As illustrated in FIG. 1, the working machine 1 includes a machine body (swivel base) 2, a traveling device 3, and a working device 4. A cabin 5 is mounted on the machine body 2. An operator's seat 6, on which an operator sits, is provided inside the cabin 5. The operator's seat 6 is enclosed by the cabin 5. The operator's seat 6 includes a seat portion 6A, which is a portion where the operator sits, and a backrest portion 6B, which is a portion for supporting the back of the operator.

In the present embodiment, the term "forward", etc. will be used for referring to a direction going forward with respect to the operator on the operator's seat 6 of the working machine 1 (direction indicated by an arrow A1 in FIG. 1), the term "rearward", etc. will be used for referring to a direction going rearward with respect to the operator (direction indicated by an arrow A2 in FIG. 1), the term "leftward", etc. will be used for referring to a direction going leftward with respect to the operator (direction toward the near side in FIG. 1), the term "rightward", etc. will be used for referring to a direction going rightward with respect to the operator (direction toward the far side in FIG. 1), and the direction indicated by an arrow K1 in FIG. 1 will be referred to as "front-rear direction". As illustrated in FIG. 1, a horizontal direction orthogonal to the front-rear direction K1 will be referred to as "machine-body width direction" (width direction of the machine body 2). The direction going rightward or leftward from the center of the machine body 2 in the width direction will be referred to as "machine-body outward direction" (outward in the machine-body width direction). In other words, the machine-body outward direction is a kind of the machine-body width direction and can be defined as a direction going away from the center of the machine body 2 in the width direction. The opposite directional concept of the machine-body outward direction will be referred to as "machine-body inward direction" (inward in the machine-body width direction). In other words, the machine-body inward direction is a kind of the machine-body width direction and can be defined as a direction coming closer to the center of the machine body 2 in the width direction.

As illustrated in FIG. 1, the traveling device 3 is a device that supports the machine body 2 to make it travelable. The traveling device 3 is driven by a traveling motor 11, which is, for example, a hydraulic motor (hydraulic actuator) or an electric motor. In the present embodiment, the traveling device 3 is a crawler-type traveling device, but not limited thereto. A wheeled traveling device, etc. may be used instead. A dozer device 7 is mounted on the front of the traveling device 3. The dozer device 7 includes a blade (dozer blade) 7A, a dozer arm 7B fixed to the back of the blade 7A and capable of moving up and down by being pivotally supported, at its rear portion, on the frame of the traveling device 3, and a dozer cylinder (hydraulic cylinder) 7C configured to move the dozer arm 7B up and down.

The machine body 2 includes a swivel board 9 constituting the bottom of the machine body 2 and made of, for example, a steel plate. The swivel board 9 is supported via a swivel bearing 8 on the traveling device 3 such that swiveling around a swivel axis X1 extending in a vertical direction is enabled. A swivel motor 12, which is a hydraulic motor (hydraulic actuator) configured to drive the machine body 2 for rotation around the swivel axis X1, is mounted on the swivel board 9. A weight 10 and a prime mover are mounted at the rear of the machine body 2. The prime mover is a diesel engine. The prime mover may be a gasoline engine or an electric motor. Alternatively, the prime mover may be a hybrid-type device that includes an engine and an electric motor.

The machine body 2 includes support brackets 20, which support the working device 4, and a swing bracket 21 at its front portion. The support brackets 20 protrude forward from the machine body 2. The swing bracket 21 is mounted on the front of the support brackets 20 (portion protruding from the machine body 2) in such a way as to be able to perform pivotal motion around a vertical axis (axis extending vertically). The swing bracket 21 is driven for the pivotal motion by a swing cylinder (hydraulic cylinder).

As illustrated in FIG. 1, the working device 4 includes a boom device 30, an arm device 40, and a working tool device 50. The boom device 30 includes a boom 31 and a boom cylinder (hydraulic actuator) 32. The boom 31 is supported, at its proximal portion, on the top of the swing bracket 21 in such a way as to be able to pivot (rotate freely) by a horizontal shaft 35 extending in the machine-body width direction. The boom cylinder 32 is an extendable-retractable hydraulic cylinder. The boom cylinder 32 is provided between the swing bracket 21 and a midpoint portion of the boom 31 halfway therealong. The boom cylinder 32 causes the boom 31 to operate pivotally by its extending-and-retracting motion.

The arm device 40 includes an arm 41 and an arm cylinder (hydraulic actuator) 42. The proximal end of the arm 41 is pivotally supported on the distal end of the boom 31 by a horizontal shaft 43. The arm cylinder 42 is another extendable-retractable hydraulic cylinder. The arm cylinder 42 is provided between the proximal portion of the arm 41 and another midpoint portion of the boom 31 halfway therealong. The arm cylinder 42 causes the arm 41 to operate pivotally by its extending-and-retracting motion.

The working tool device 50 includes a bucket 51, which serves as a working tool, and a bucket cylinder (hydraulic actuator) 52, which serves as a working tool cylinder. The bucket 51 is pivotally supported on the distal end of the arm 41 by a pivot 57. The bucket cylinder 52 is another extendable-retractable hydraulic cylinder. The bucket cylinder 52 is provided between a link mechanism 53, which is provided between the bucket 51 and the distal end of the arm 41, and the proximal portion of the arm 41. The bucket cylinder 52 causes the bucket 51 to operate pivotally by its extending-and-retracting motion.

Figure 2:
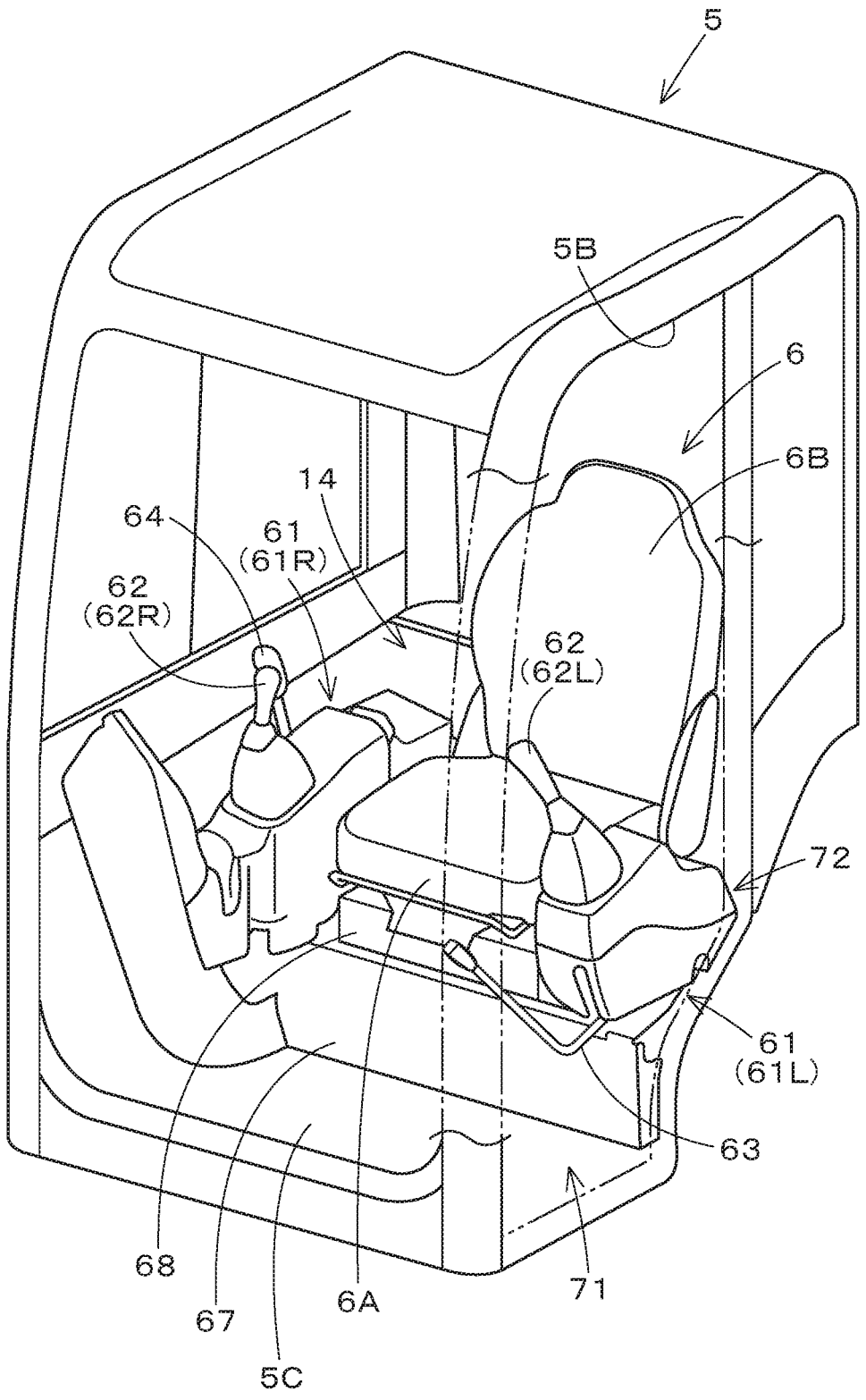
FIG. 2 is a perspective view illustrating a cabin and an operator's station.

As illustrated in FIG. 1, a door 5A is provided on a side (left side) of the cabin 5. The door 5A is supported at its rear portion by a hinge 13 in such a way as to be able to rotate around a vertical axis. By being turned around the hinge 13, the front portion of the door 5A moves outward in the machine-body width direction, thereby opening or closing an entrance/exit gate 5B. The entrance/exit gate 5B is an opening through which the operator gets into/out of the cabin 5 (on/off the operator's seat 6). As illustrated in FIG. 2, an operator's station 14 is provided inside the cabin 5. The operator's station 14 includes the operator's seat 6, and devices and parts around the operator's seat 6. The operator's station 14 includes manipulator bases 61 disposed to the left and right of the operator's seat 6. The manipulator base 61 disposed to the left of the operator's seat 6 will be referred to as "first manipulator base 61L", and the manipulator base 61 disposed to the right of the operator's seat 6 will be referred to as "second manipulator base 61R". A first manipulation lever (manipulation member 62) 62L to be manipulated to operate a plurality of hydraulic actuators, and an operation lever 63 for moving the first manipulator base 61L pivotally up and down, are provided on the first manipulator base 61L. A second manipulation lever (manipulation member 62) 62R to be manipulated to operate a plurality of hydraulic actuators, and a dozer lever 64 for operating the dozer device 7, are provided on the second manipulator base 61R.

Both the first manipulation lever 62L and the second manipulation lever 62R are configured to be able to be manipulated by the operator to operate respective two manipulation targets which the working machine 1 is equipped with. The manipulation targets of the first manipulation lever 62L and the second manipulation lever 62R are, for example, the swivel motor 12, the boom cylinder 32, the arm cylinder 42, and the bucket cylinder 52. That is, the manipulation member 62 can be used for causing swiveling operation of the machine body 2, pivotal operation of the arm 41, pivotal operation of the bucket 51, and pivotal operation of the boom 31. A manipulating direction of each of the first manipulation lever 62L and the second manipulation lever 62R (manipulation member), and a swiveling/pivotal manipulation amount thereof, are detected by a detection sensor 65 (see FIG. 3).

Figure 3:
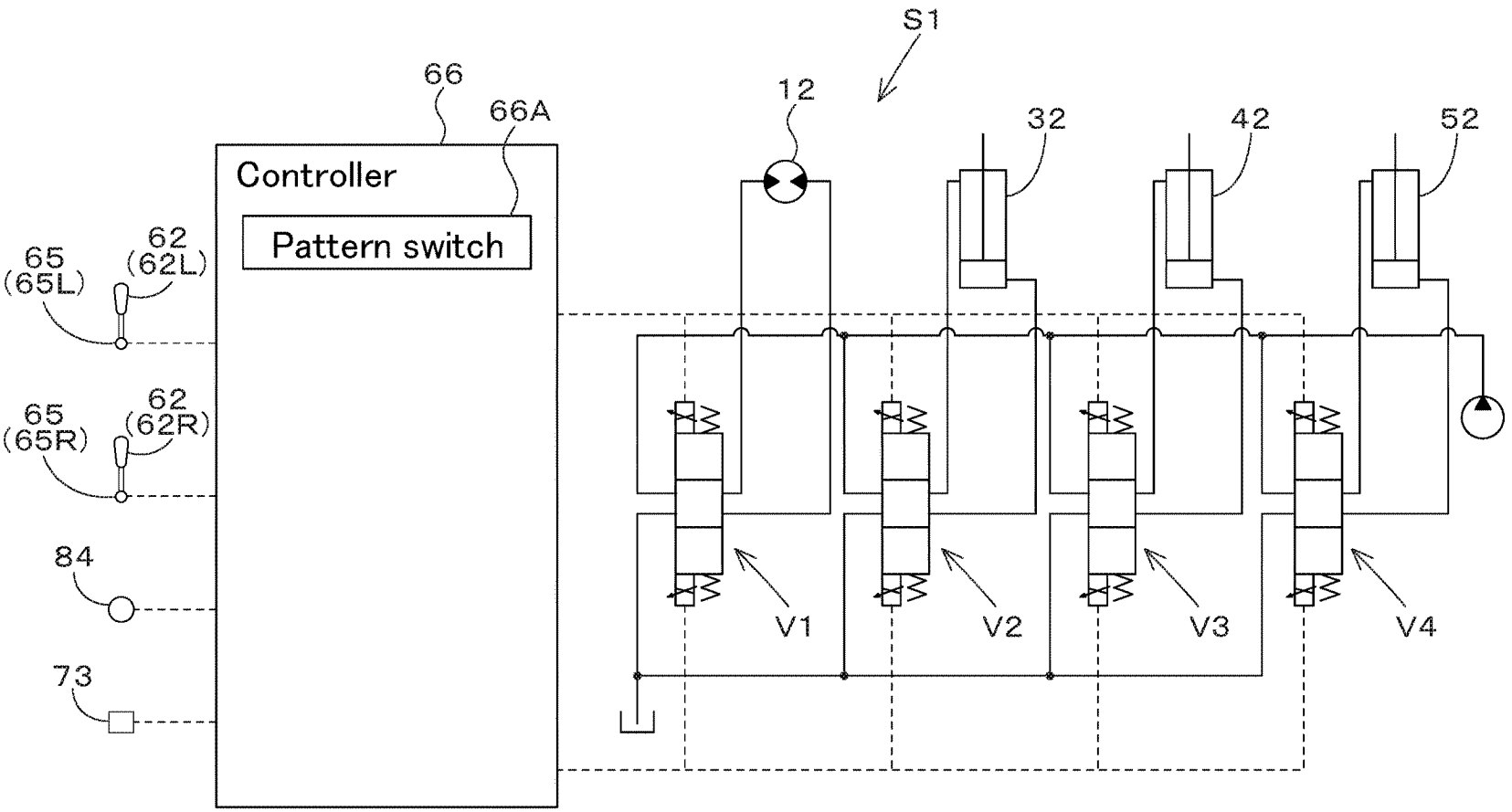
FIG. 3 is a configuration diagram illustrating a control system.

More specifically, as illustrated in FIG. 3, the manipulating direction of the first manipulation lever 62L and the swiveling/pivotal manipulation amount thereof are detected by a first detection sensor 65L. The manipulating direction of the second manipulation lever 62R and the swiveling/pivotal manipulation amount thereof are detected by a second detection sensor 65R. The first detection sensor 65L and the second detection sensor 65R are connected to a controller 66. The controller 66 is capable of acquiring detection signals of the first detection sensor 65L and the second detection sensor 65R. The controller 66 is configured using a microcomputer including, for example, a central processing unit (CPU), an electrically erasable programmable read-only memory (EEPROM), and the like.

FIG. 3 illustrates a control system S1 that controls the swivel motor 12, the boom cylinder 32, the arm cylinder 42, and the bucket cylinder 52. The control system S1 includes a swiveling control valve V1 for hydraulic control of the swivel motor 12, a boom control valve V2 for hydraulic control of the boom cylinder 32, an arm control valve V3 for hydraulic control of the arm cylinder 42, and a bucket control valve V4 for hydraulic control of the bucket cylinder 52. The swiveling control valve V1, the boom control valve V2, the arm control valve V3, and the bucket control valve V4 are solenoid valves controlled electrically by the controller 66. The detection signals of the first detection sensor 65L and the second detection sensor 65R are sent to the controller 66. Based on the detection signals sent from the first detection sensor 65L and the second detection sensor 65R, the controller 66 controls the control valves for controlling the manipulation targets.

One example of a manipulation pattern of the first manipulation lever 62L and the second manipulation lever 62R will now be explained. The first manipulation lever 62L and the second manipulation lever 62R are swingable in the front-rear direction K1 (forward and rearward) and swingable in the machine-body width direction (leftward and rightward). Forward/rearward swing manipulation of the first manipulation lever 62L causes pivotal operation of the arm 41. Leftward/rightward swing manipulation of the first manipulation lever 62L causes swiveling operation of the machine body 2. Forward/rearward swing manipulation of the second manipulation lever 62R causes pivotal operation of the boom 31. Leftward/rightward swing manipulation of the second manipulation lever 62R causes pivotal operation of the bucket 51.

The controller 66 includes a pattern switch 66A configured to switch the manipulation pattern of the manipulation member 62 for a plurality of hydraulic actuators among a plurality of manipulation patterns. In the present embodiment, switching is available from among four manipulation patterns, inclusive of the manipulation pattern described above. A first manipulation pattern is the manipulation pattern described above.

In a second manipulation pattern, forward/rearward swing manipulation of the first manipulation lever 62L causes swiveling operation of the machine body 2, and leftward/rightward swing manipulation of the first manipulation lever 62L causes pivotal operation of the arm 41. In addition, in the second manipulation pattern, forward/rearward swing manipulation of the second manipulation lever 62R causes pivotal operation of the boom 31, and leftward/rightward swing manipulation of the second manipulation lever 62R causes pivotal operation of the bucket 51. In a third manipulation pattern, forward/rearward swing manipulation of the first manipulation lever 62L causes pivotal operation of the boom 31, and leftward/rightward swing manipulation of the first manipulation lever 62L causes pivotal operation of the bucket 51. In addition, in the third manipulation pattern, forward/rearward swing manipulation of the second manipulation lever 62R causes pivotal operation of the arm 41, and leftward/rightward swing manipulation of the second manipulation lever 62R causes swiveling operation of the machine body 2.

In a fourth manipulation pattern, forward/rearward swing manipulation of the first manipulation lever 62L causes pivotal operation of the boom 31, and leftward/rightward swing manipulation of the first manipulation lever 62L causes pivotal operation of the bucket 51. In addition, in the fourth manipulation pattern, forward/rearward swing manipulation of the second manipulation lever 62R causes pivotal operation of the arm 41, and leftward/rightward swing manipulation of the second manipulation lever 62R causes swiveling operation of the machine body 2. As illustrated in FIG. 2, the operator's seat 6 is mounted on a seat table 67 installed on a floor 5C of the cabin 5 (machine body 2).

Figure 4:
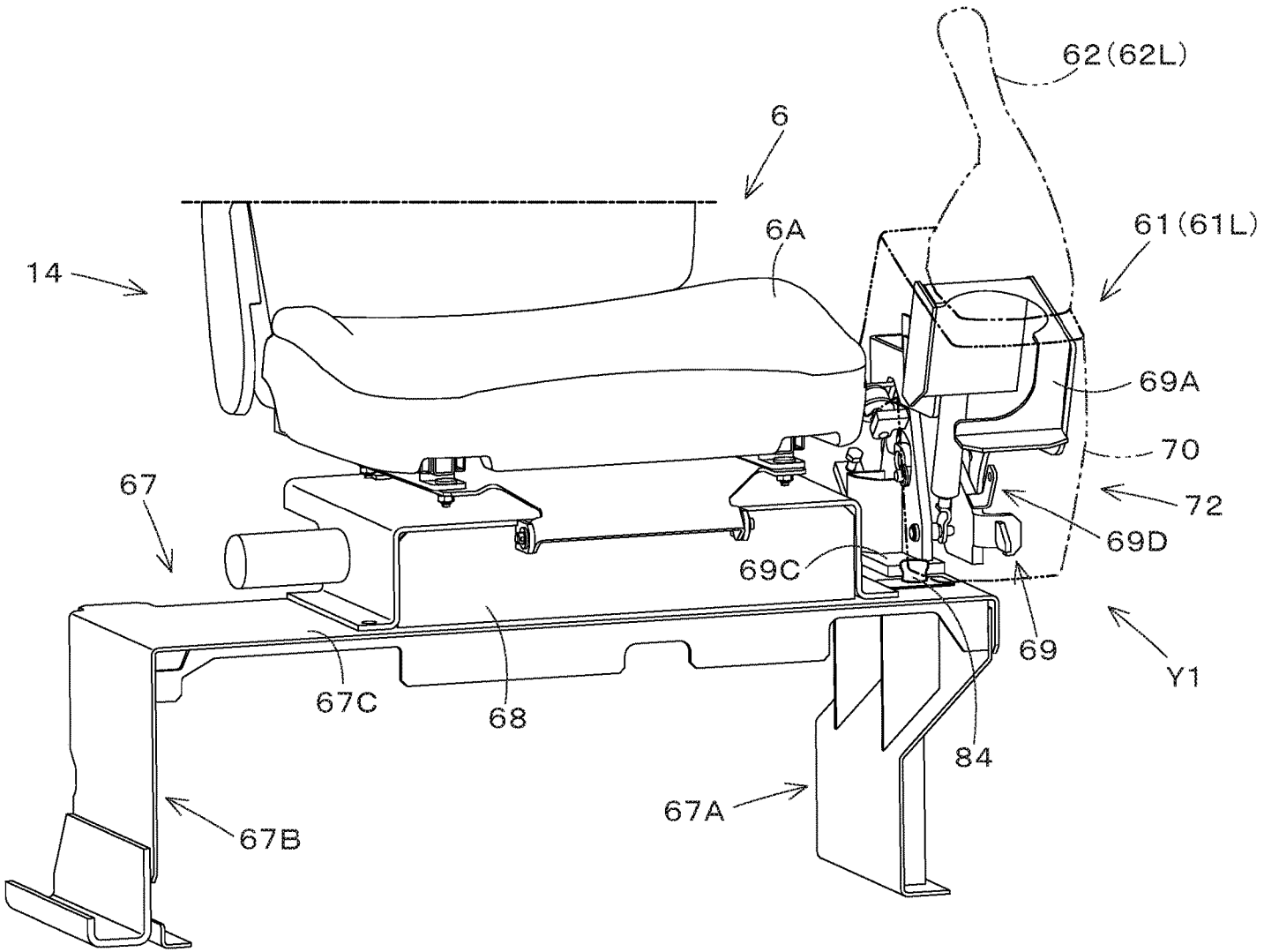
FIG. 4 is a perspective view of the operator's station from a viewpoint obliquely to the right thereof and ahead thereof.

As illustrated in FIG. 4, the seat table 67 includes a first leg portion 67A standing upright on the floor 5C, a second leg portion 67B standing upright on the floor 5C to the right of the first leg portion 67A with a space therebetween, and a top wall portion 67C bridging from the top end of the first leg portion 67A to the top end of the second leg portion 67B. The operator's seat 6 is installed over the seat table 67, with a supporting pedestal 68 provided therebetween. The supporting pedestal 68 has a smaller width in the machine-body width direction than the seat table 67. Accordingly, the top wall portion 67C of the seat table 67 protrudes to the left and right from the supporting pedestal 68. The operator's seat 6 is mounted on the supporting pedestal 68 such that its position is adjustable in the front-rear direction while being guided along slide rails.

Figure 5:
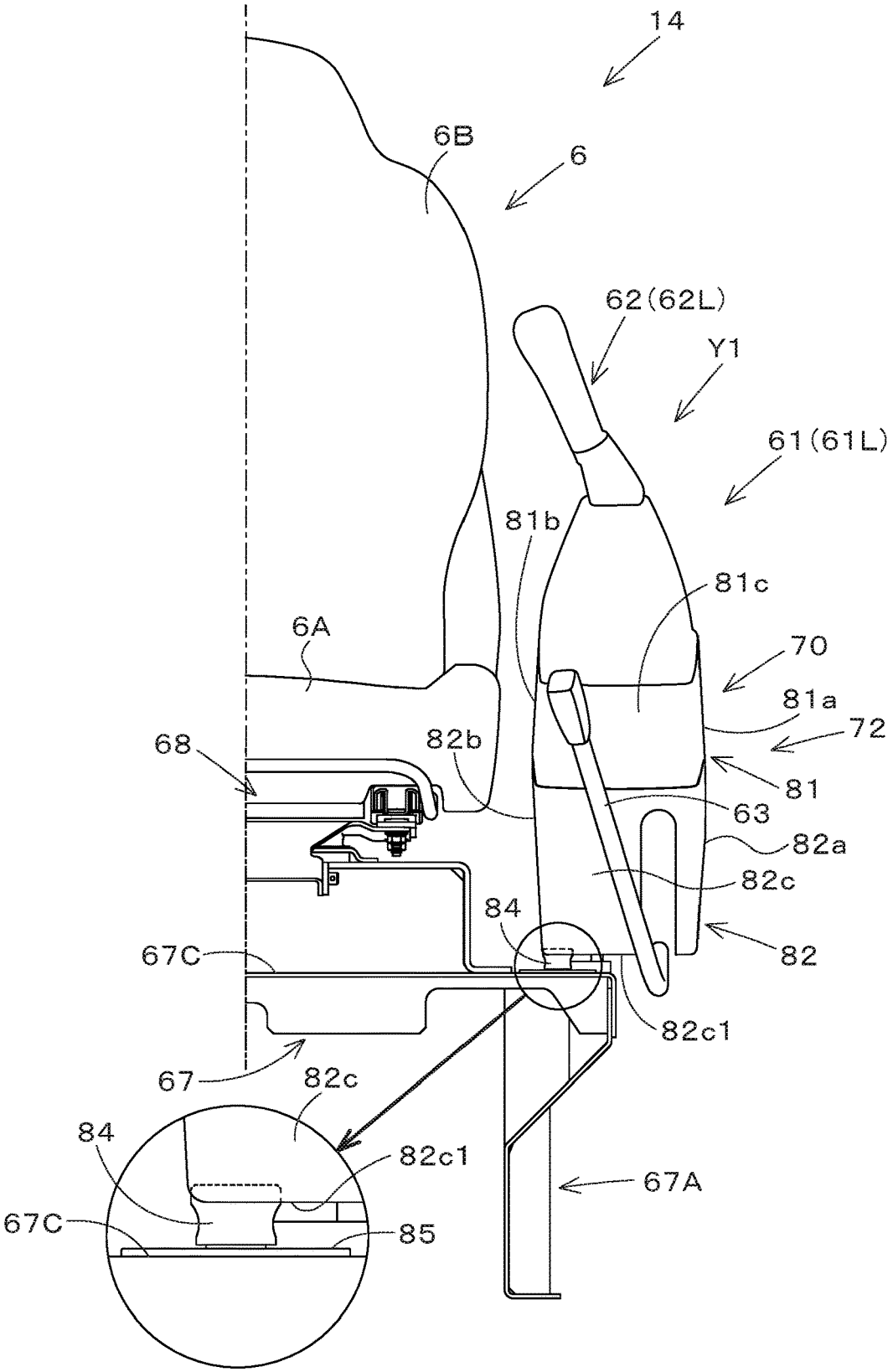
FIG. 5 is a front view illustrating a portion where a pattern switching member is disposed.
Figure 6:
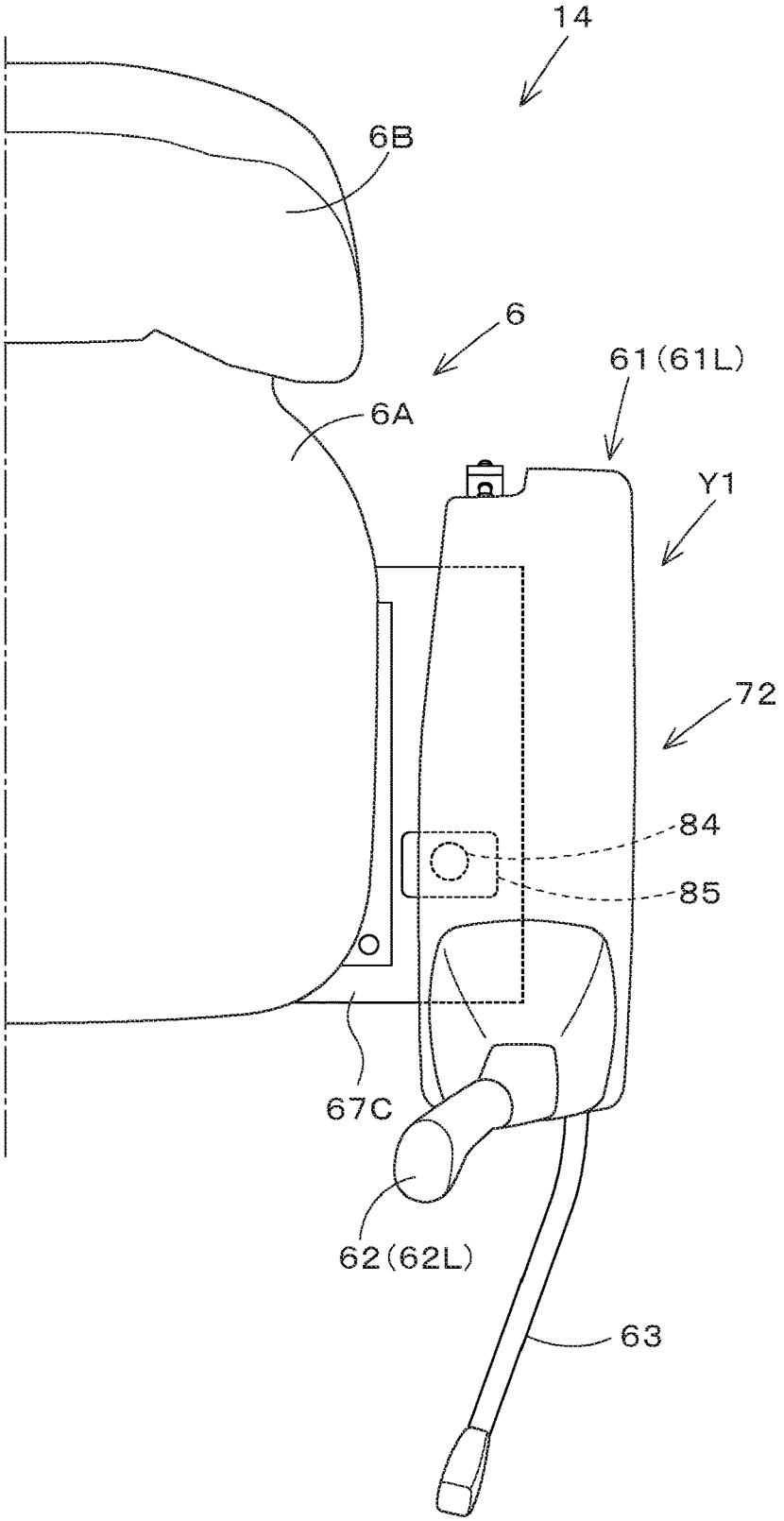
FIG. 6 is a plan view illustrating the portion where the pattern switching member is disposed.
Figure 7:
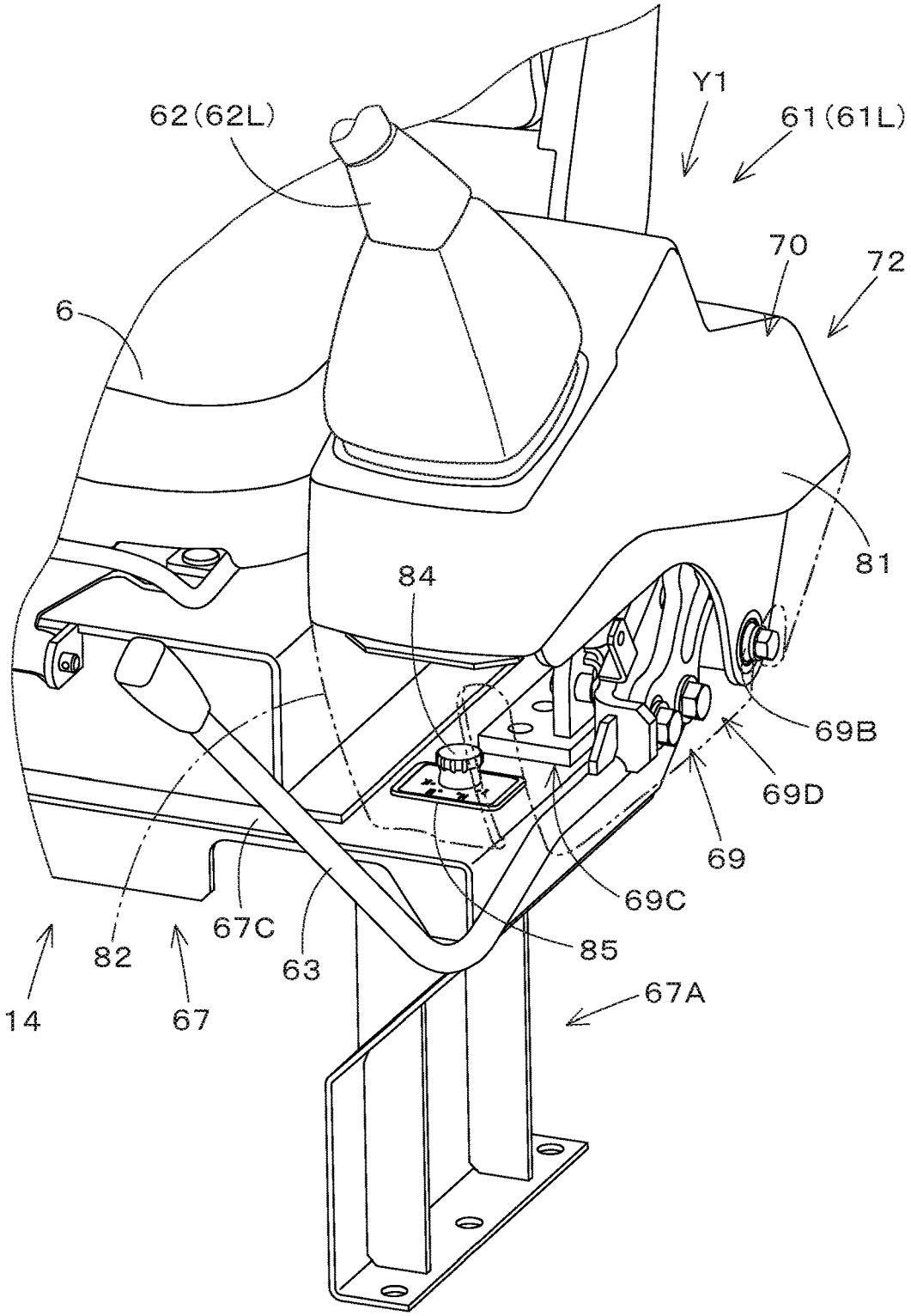
FIG. 7 is a perspective view illustrating the portion where the pattern switching member is disposed.
Figure 8:
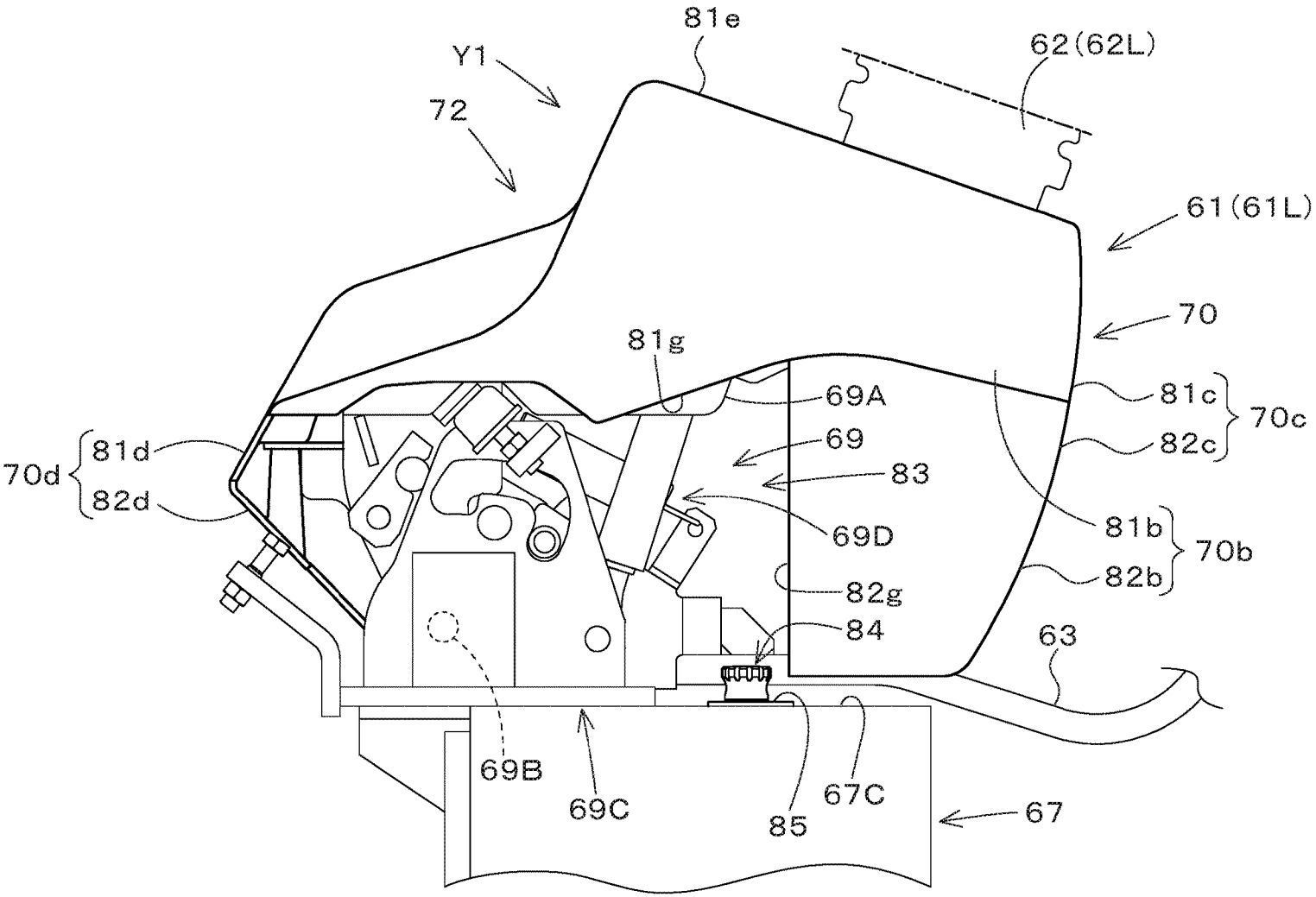
FIG. 8 is a right side view of a first manipulator base.

As illustrated in FIGS. 4, 5, and 6, the first manipulator base 61L is disposed to the left of the operator's seat 6 over the left part of the top wall portion 67C of the seat table 67, and is mounted on and thus supported by the seat table 67. As illustrated in FIGS. 4, 7, and 8, the manipulator base 61 includes a supporting structure body 69, and an open-bottomed manipulator base cover 70 for covering the supporting structure body 69. The supporting structure body 69 includes a frame member 69A, a rotation shaft 69B, a support bracket 69C, and a rotation mechanism 69D, etc. The first manipulation lever 62L and the like are mounted on the frame member 69A. The rotation shaft 69B supports the frame member 69A, etc. rotatably around its axis extending in the machine-body width direction. The rotation shaft 69B is mounted on the support bracket 69C, and the support bracket 69C is provided on the top wall portion 67C of the seat table 67. The rotation mechanism 69D is configured to rotate the frame member 69A.

Figure 9:
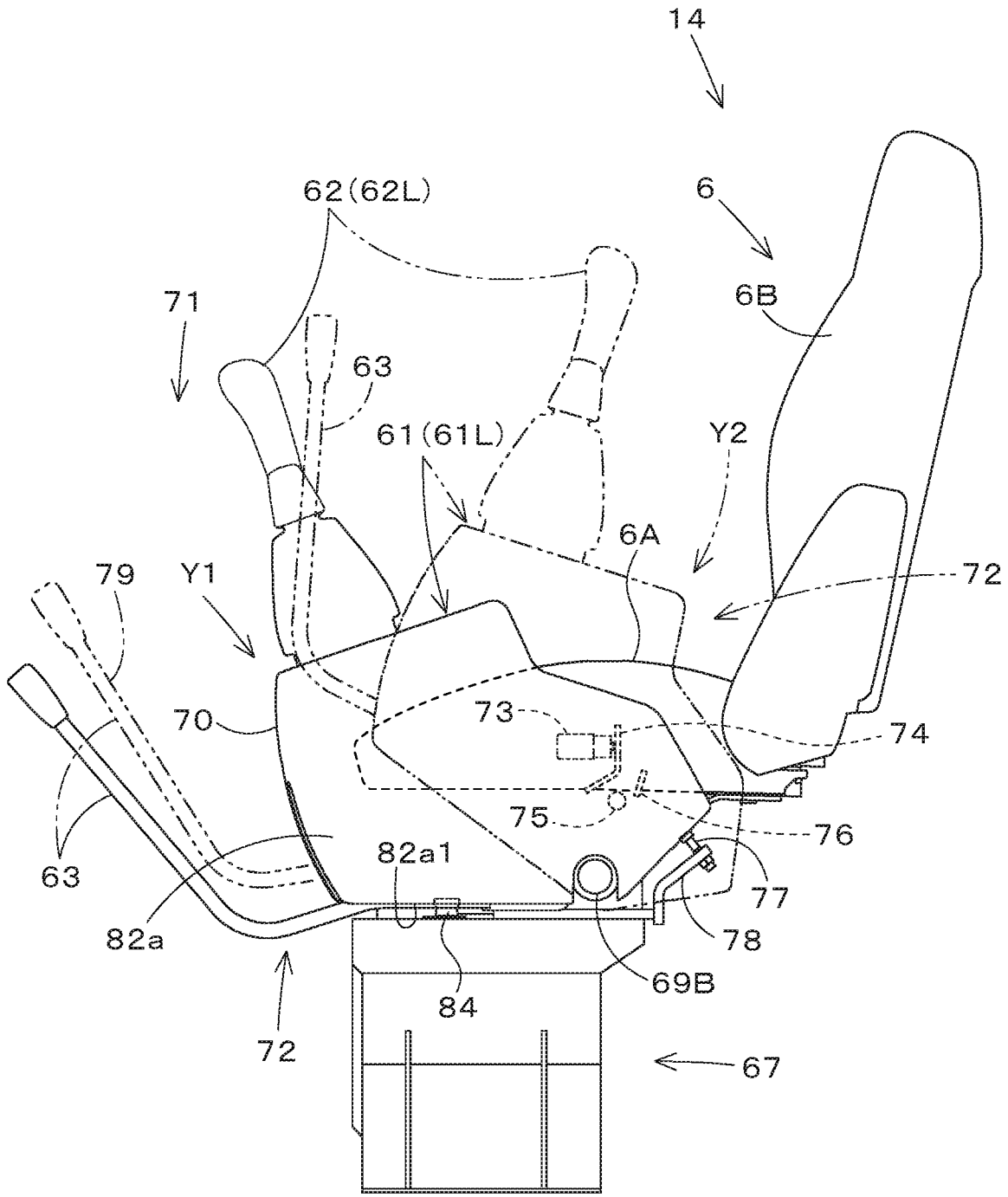
FIG. 9 is a side view of the operator's station.

As illustrated in FIG. 9, the rotation shaft 69B is located at the lower end of the rear portion of the first manipulator base 61L. Therefore, the first manipulator base 61L is able to move pivotally up and down around its pivotal portion (rotation shaft 69B) at its lower end of its rear portion. The first manipulator base 61L is able to switch its positional orientation between a first position Y1, which is depicted by solid-line illustration in FIG. 9, and a second position Y2, which is shifted pivotally up from the first position Y1 as depicted by dot-dot-dash-line illustration in FIG. 9. In a side view illustrated in FIG. 9, when the first manipulator base 61L is in the first position Y1, the lower end of the first manipulator base 61L at its part ahead of the rotation shaft 69B is located near, and substantially in parallel with, the top wall portion 67C of the seat table 67, whereas, when the first manipulator base 61L is in the second position Y2, said lower end is sloped up forward.

As depicted by solid-line illustration in FIG. 9, the front portion of the first manipulator base 61L, when in the first position Y1, protrudes forward beyond the seat portion 6A of the operator's seat 6; in addition, in this state, the operation lever 63 protrudes forward from the first manipulator base 61L. Therefore, the first position Y1 is positional orientation that prevents the operator from getting on/off the operator's seat 6. More particularly, the first position Y1 is positional orientation that prevents the operator from walking in/out through an entrance/exit aisle 71 between the operator's seat 6 and the entrance/exit gate 5B.

As depicted by dot-dot-dash-line illustration in FIG. 9, the first manipulator base 61L, when in the second position Y2, is inclined in a "sloped-up-forward" manner; in addition, in this state, the operation lever 63 is out of the way of the entrance/exit aisle 71 by being moved pivotally up around the rotation shaft 69B together with the first manipulator base 61L. Therefore, the second position Y2 is positional orientation that allows the operator to get on/off the operator's seat 6. More particularly, the second position Y2 is positional orientation that allows the operator to walk in/out through the entrance/exit aisle 71 between the operator's seat 6 and the entrance/exit gate 5B.

In the present embodiment, the first manipulator base 61L and the operation lever 63 constitute an operating body 72 disposed in proximity to the operator's seat 6 and switchable between the first position Y1 and the second position Y2. The operating body 72 may be any member disposed in proximity to the operator's seat 6. For example, the operating body 72 may be a member disposed in front of the operator's seat 6 and switchable between the first position Y1 and the second position Y2. As illustrated in FIG. 9, the first manipulator base 61L includes a detection switch 73, a contact member 74, a pivot 75, a restriction contact portion 76, and a stopper member 77. The detection switch 73, the contact member 74, the pivot 75, and the restriction contact portion 76 are provided on the rotation mechanism 69D. The stopper member 77 is mounted on a stay member 78 fixed to the support bracket 69C.

As illustrated in FIG. 9, when the first manipulator base 61L and the operation lever 63 (operating body 72) are in the first position Y1, the contact member 74 is in contact with a contact socket of the detection switch 73, and it is therefore detected that the first manipulator base 61L and the operation lever 63 (operating body 72) are in the first position Y1. As illustrated in FIG. 3, the detection switch 73 is connected to the controller 66. The controller 66 is capable of acquiring a detection signal of the detection switch 73. Upon acquiring the detection signal from the detection switch 73, the controller 66 enables the operation of the swivel motor 12, the boom cylinder 32, the arm cylinder 42, and the bucket cylinder 52. That is, when the first manipulator base 61L and the operation lever 63 (operating body 72) are in the first position Y1, based on instruction signals received from the first detection sensor 65L and the second detection sensor 65R, the controller 66 controls the swiveling control valve V1, the boom control valve V2, the arm control valve V3, and the bucket control valve V4.

Next, the operator grips and then pulls up the operation lever 63 to switch the first manipulator base 61L and the operation lever 63 (operating body 72) from the first position Y1 into the second position Y2 as illustrated in FIG. 9. When this switching occurs, first, the operation lever 63 moves pivotally up around the pivot 75 as depicted by dot-dot-dash-line illustration 79, and, the contact member 74, linked with this pivotal lever movement, is released from the contact socket of the detection switch 73. Then, the first manipulator base 61L and the operation lever 63 (operating body 72) rotate together around the rotation shaft 69B, with the contact member 74 being away from the contact socket of the detection switch 73, thereby pivotally shifting into the second position Y2. In a state in which the contact member 74 is away from the contact socket of the detection switch 73 and thus in which the controller 66 acquires no detection signal from the detection switch 73, the controller 66 disables the operation of the swivel motor 12, the boom cylinder 32, the arm cylinder 42, and the bucket cylinder 52. That is, when the first manipulator base 61L and the operation lever 63 (operating body 72) are in the second position Y2, even if detection signals are received from the first detection sensor 65L and the second detection sensor 65R, the controller 66 does not send control signals to the swiveling control valve V1, the boom control valve V2, the arm control valve V3, and the bucket control valve V4 and therefore does not control these control valves.

Figure 10:
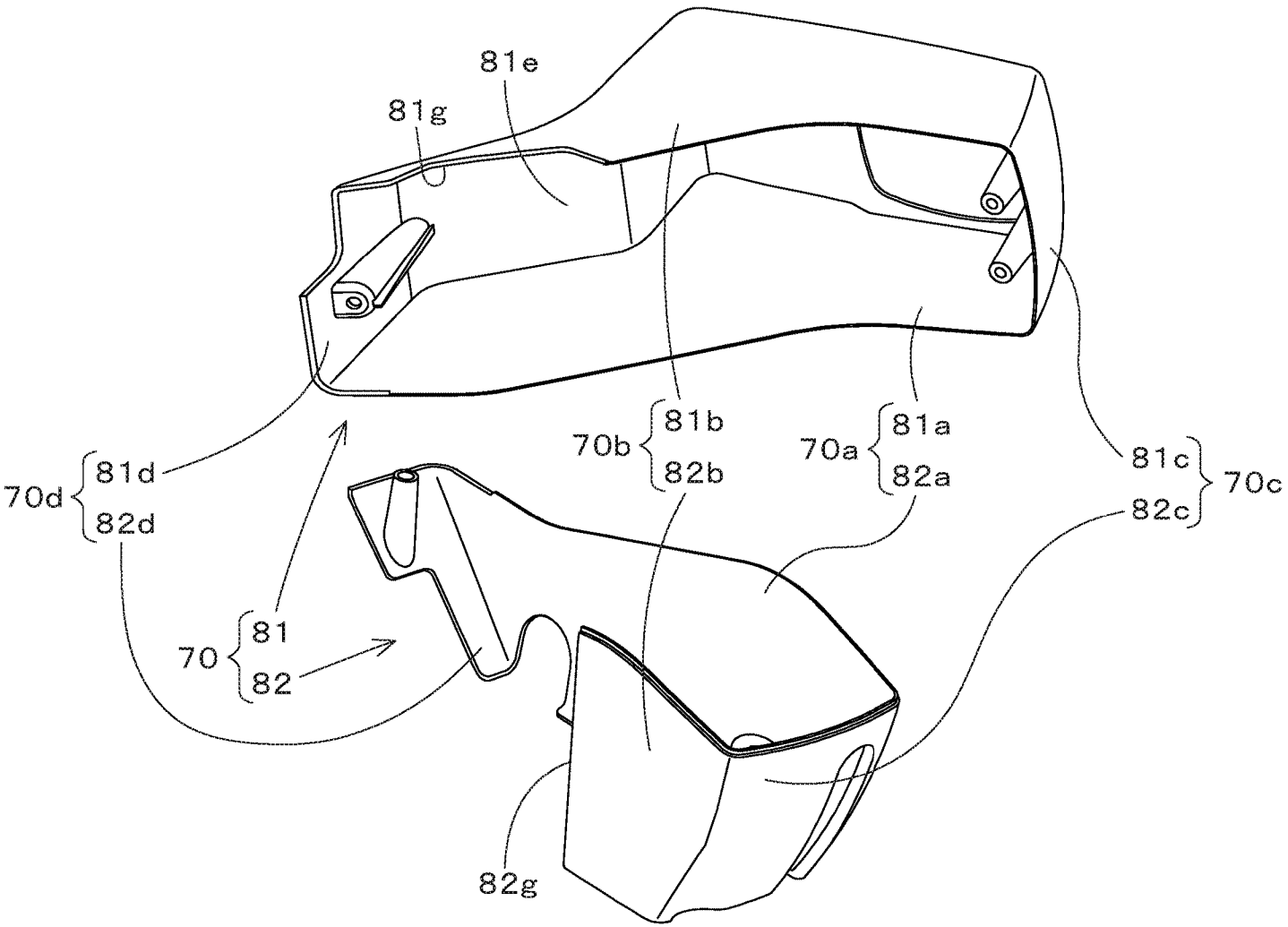
FIG. 10 is an exploded perspective view of a manipulator base cover.

On the other hand, when the first manipulator base 61L and the operation lever 63 (operating body 72) are in the second position Y2, the restriction contact portion 76 is in contact with the stopper member 77, and the movement of the first manipulator base 61L in a rotating direction from the first position Y1 to the second position Y2 is restricted. The first manipulator base 61L is configured to be held in the first position Y1 and the second position Y2 by a holder provided on the rotation mechanism 69D. As illustrated in FIG. 10, the manipulator base cover 70 includes an upper cover 81 and a lower cover 82. The upper cover 81 and the lower cover 82 are coupled to each other and are attached to the frame member 69A. The upper cover 81 includes an outer sidewall 81*a*, which is a sidewall on the opposite side with respect to the operator's seat 6, an inner sidewall 81*b*, which is a sidewall facing toward the operator's seat 6, a front wall 81*c*, a rear wall 81*d*, and a top wall 81*e*. The lower cover 82 includes an outer sidewall 82*a*, which is a sidewall on the opposite side with respect to the operator's seat 6, an inner sidewall 82*b*, which is a sidewall facing toward the operator's seat 6, a front wall 82*c*, and a rear wall 82*d*. The inner sidewall 82*b* extends from the right end of the front wall 82*c* rearward halfway in the front-rear direction of the manipulator base cover 70.

The outer sidewall 81*a* of the upper cover 81 and the outer sidewall 82*a* of the lower cover 82 constitute an outer sidewall 70*a* of the manipulator base cover 70. The inner sidewall 81*b* of the upper cover 81 and the inner sidewall 82*b* of the lower cover 82 constitute an inner sidewall 70*b* of the manipulator base cover 70. The front wall 81*c* of the upper cover 81 and the front wall 82*c* of the lower cover 82 constitute a front wall 70*c* of the manipulator base cover 70. The rear wall 81*d* of the upper cover 81 and the rear wall 82*d* of the lower cover 82 constitute a rear wall 70*d* of the manipulator base cover 70. The top wall 81*e* of the upper cover 81 is the top wall of the manipulator base cover 70. The lower cover 82 has no bottom. Namely, the manipulator base cover 70 has an open-bottomed shape.

As illustrated in FIG. 8, the manipulator base cover 70 has a side opening portion 83, which is open toward the operator's seat 6 and located behind its inner sidewall 70*b* (a portion having a wall facing toward the operator's seat 6). The side opening portion 83 is made up of a lower edge 81*g* of the inner sidewall 81*b* of the upper cover 81 and a rear edge 82*g* of the inner sidewall 82*b* of the lower cover 82. As illustrated in FIGS. 4 to 7, a pattern switching member 84 configured to switch the manipulation pattern of the manipulation member 62 among a plurality of manipulation patterns is disposed beside (to the left of) the operator's seat 6 under the first manipulator base 61L. The pattern switching member 84 is disposed on the top wall portion 67C to the left of the supporting pedestal 68 on a front portion of the top wall portion 67C.

The pattern switching member 84 is a rotary switch (switch). The pattern switching member 84 is mounted on a base plate 85, which is mounted on the top wall portion 67C of the seat table 67, in such a way as to be able to rotate around a vertical axis. As illustrated in FIG. 3, the pattern switching member 84 is connected to the controller 66. The controller 66 is capable of acquiring a switching operation signal from the pattern switching member 84. Upon acquiring the switching operation signal from the pattern switching member 84 by the controller 66, the pattern switch 66A sets the manipulation pattern of the manipulation member 62 into a manipulation pattern corresponding to a switching operation position of the pattern switching member 84. That is, the manipulation pattern is set into any one of the first to fourth manipulation patterns.

Figure 12:
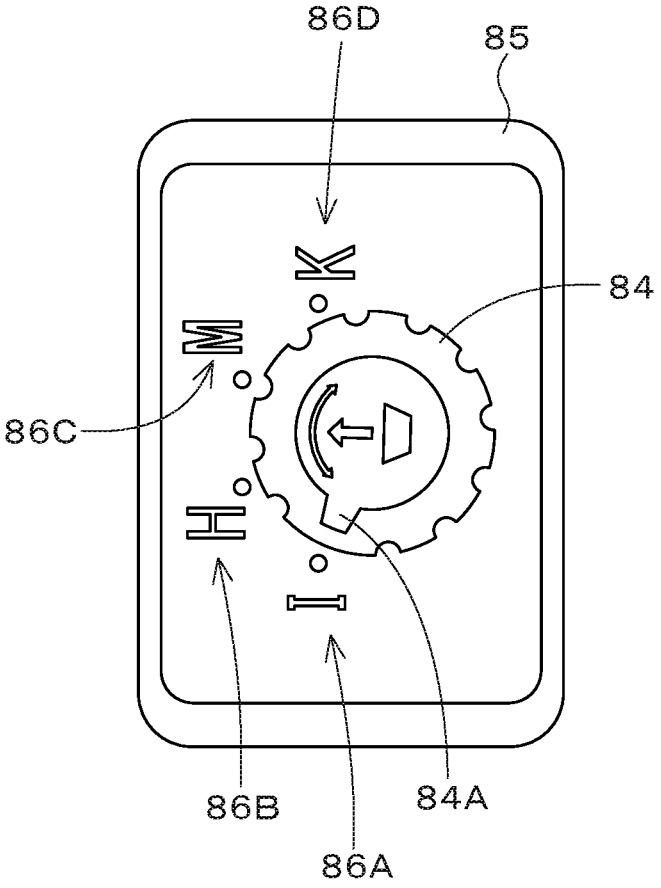
FIG. 12 is a plan view of the pattern switching member.

As illustrated in FIG. 12, an I mark 86A, an H mark 86B, an M mark 86C, and a K mark 86D are provided in this order from the left on a front portion the base plate 85 (around a front portion of the pattern switching member 84). The pattern switching member 84 has a pointer 84A. By dialing the pattern switching member 84 to make the pointer 84A point to any one of the I mark 86A, the H mark 86B, the M mark 86C, and the K mark 86D, it is possible to switch the manipulation pattern of the manipulation member 62. For example, the pattern switch 66A switches the manipulation pattern of the manipulation member 62 to the first manipulation pattern when the pointer 84A is set to point to the I mark 86A. The pattern switch 66A switches the manipulation pattern of the manipulation member 62 to the second manipulation pattern when the pointer 84A is set to point to the H mark 86B. The pattern switch 66A switches the manipulation pattern of the manipulation member 62 to the third manipulation pattern when the pointer 84A is set to point to the M mark 86C. The pattern switch 66A switches the manipulation pattern of the manipulation member 62 to the fourth manipulation pattern when the pointer 84A is set to point to the K mark 86D.

Figure 11:
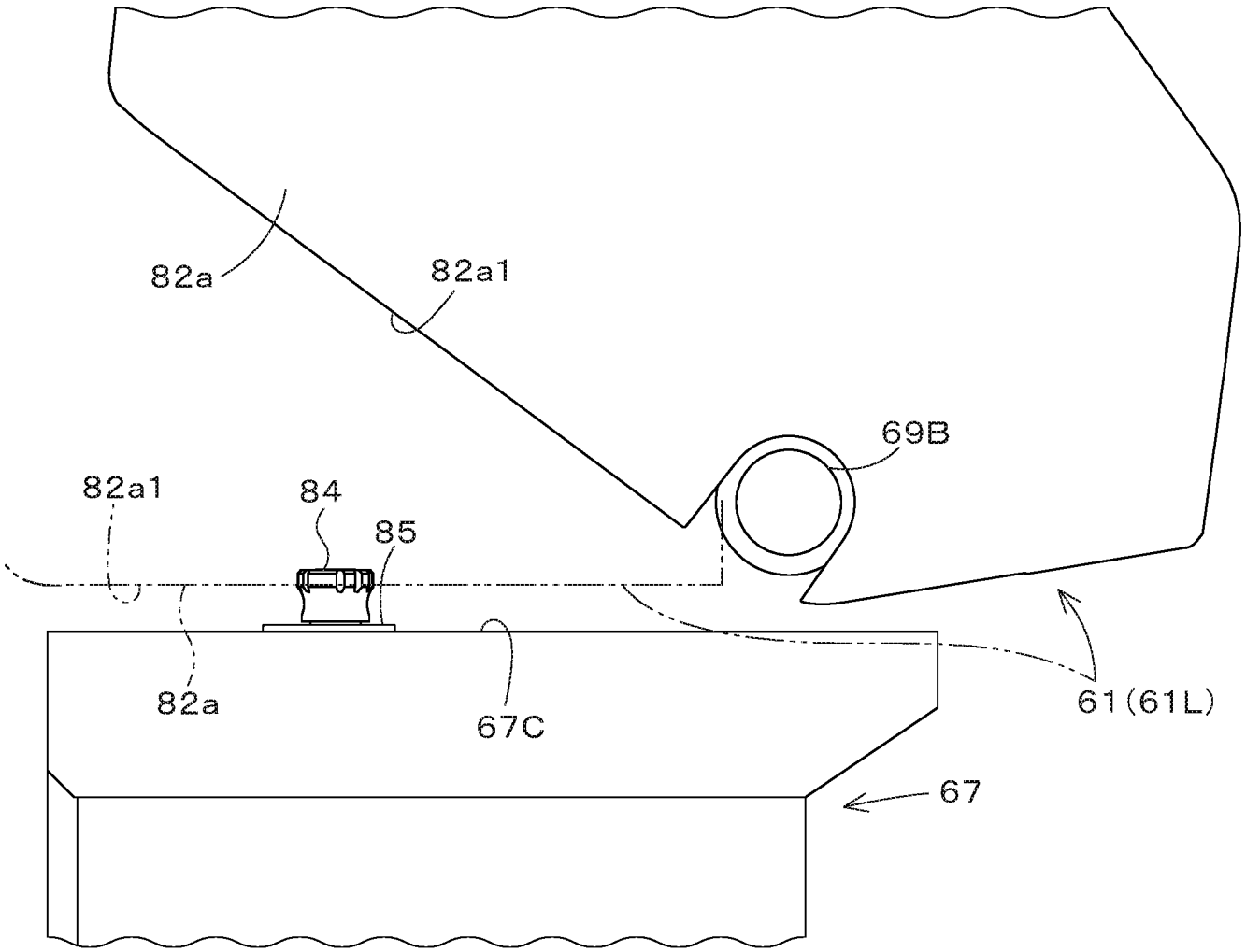
FIG. 11 is an enlarged side view illustrating the portion where the pattern switching member is disposed.

As illustrated in FIGS. 6, 9, and 11, when the first manipulator base 61L and the operation lever 63 (operating body 72) are in the first position Y1, the pattern switching member 84 is located under a front portion of the first manipulator base 61L and is located inside an area of, and closer to the lower end of, the manipulator base cover 70. Therefore, when the first manipulator base 61L and the operation lever 63 (operating body 72) are in the first position Y1, the pattern switching member 84 is covered by the first manipulator base 61L (operating body 72) from above and, therefore, the pattern switching member 84 cannot be operated from above. Moreover, as illustrated in FIGS. 5 and 11, when the first manipulator base 61L and the operation lever 63 (operating body 72) are in the first position Y1, the top portion of the pattern switching member 84 is located above a lower end 82*c*1 of the front wall 82*c*, which is a wall portion of the manipulator base cover 70 covering the front of the pattern switching member 84, and above a lower end 82*a*1 of the outer sidewall 82*a*, which is a wall portion of the manipulator base cover 70 covering the outer side of the pattern switching member 84. That is, when the first manipulator base 61L and the operation lever 63 (operating body 72) are in the first position Y1, it is difficult to operate the pattern switching member 84 from ahead of it and from the outer side of it (from the left) because the front wall 82*c* and the outer sidewall 82*a* are obstructive.

It is sufficient as long as at least the top portion of the pattern switching member 84 is located above the lower end 82*c*1 of the front wall 82*c* and the lower end 82*a*1 of the outer sidewall 82*a* when the first manipulator base 61L and the operation lever 63 (operating body 72) are in the first position Y1. The whole of the pattern switching member 84 may be located above the lower end 82*c*1 of the front wall 82*c* and the lower end 82*a*1 of the outer sidewall 82*a* when the first manipulator base 61L and the operation lever 63 (operating body 72) are in the first position Y1.

As illustrated in FIG. 8, the pattern switching member 84 is located behind the front edge of the side opening portion 83 (the rear edge 82*g* of the inner sidewall 82*b*) and is exposed on the right side with respect to the first manipulator base 61L. However, it is difficult to access the pattern switching member 84 from the operator's seat 6 because there is the operator's seat 6 beside and at an inner position with respect to (to the right of) the first manipulator base 61L and because a clearance 87 between the first manipulator base 61L and the operator's seat 6 is narrow. That is, it is difficult to operate the pattern switching member 84 from the operator's seat 6.

The whole of the pattern switching member 84 does not necessarily have to be covered by the first manipulator base 61L (operating body 72) from above when the operating body 72 is in the first position Y1. It is sufficient as long as at least a part of the pattern switching member 84 is covered to an extent that makes it difficult or impossible to operate the pattern switching member 84 from the operator's seat 6. For example, it may be configured such that a part of the pattern switching member 84 is disposed under the operating body 72 and such that another part of the pattern switching member 84 is disposed at some low position in a space between the operator's seat 6 and the operating body 72 when the operating body 72 is in the first position Y1. Alternatively, the pattern switching member 84 may be disposed at an area from under the operating body 72 to under the operator's seat 6 when the operating body 72 is in the first position Y1. As another example, it may be configured such that the pattern switching member 84 is disposed under the operator's seat 6 or at an area from under the operator's seat 6 to some low position in a space between the operator's seat 6 and the operating body 72 and such that a side of the pattern switching member 84 will be covered by the first manipulator base 61L when the operating body 72 is in the first position Y1.

As described above, the pattern switching member 84 cannot be operated, or its operation is difficult, when the first manipulator base 61L and the operation lever 63 (operating body 72) are in the first position Y1. Therefore, it is possible to prevent the pattern switching member 84 from being operated when the first manipulator base 61L and the operation lever 63 (operating body 72) are in the first position Y1 and thus when operation of the hydraulic actuators is enabled.

On the other hand, as illustrated in FIGS. 9 and 11, when the first manipulator base 61L and the operation lever 63 (operating body 72) are changed from the first position Y1 to the second position Y2, the first manipulator base 61L moves pivotally up around the rotation shaft 69B to make the pattern switching member 84 exposed. When in this state, the pattern switching member 84 can be operated. That is, the pattern switching member 84 is exposed such that it can be operated when the first manipulator base 61L and the operation lever 63 (operating body 72) are in the second position Y2. Therefore, it is possible to operate the pattern switching member 84 when the first manipulator base 61L and the operation lever 63 (operating body 72) are in the second position Y2 and thus when operation of the hydraulic actuators is disabled.

Figure 13:
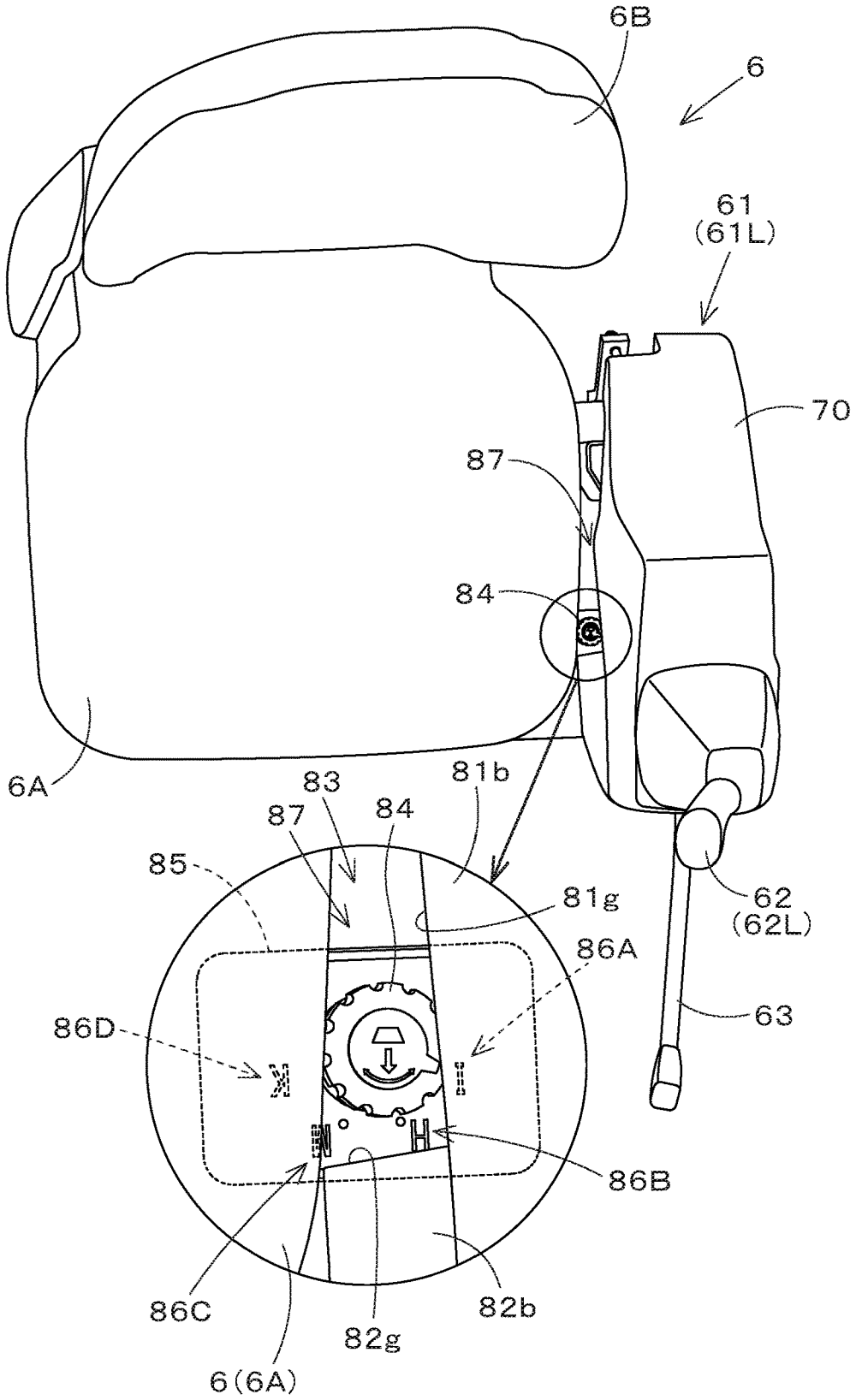
FIG. 13 is a plan perspective view illustrating a visibility state of the pattern switching member.
Figure 14:
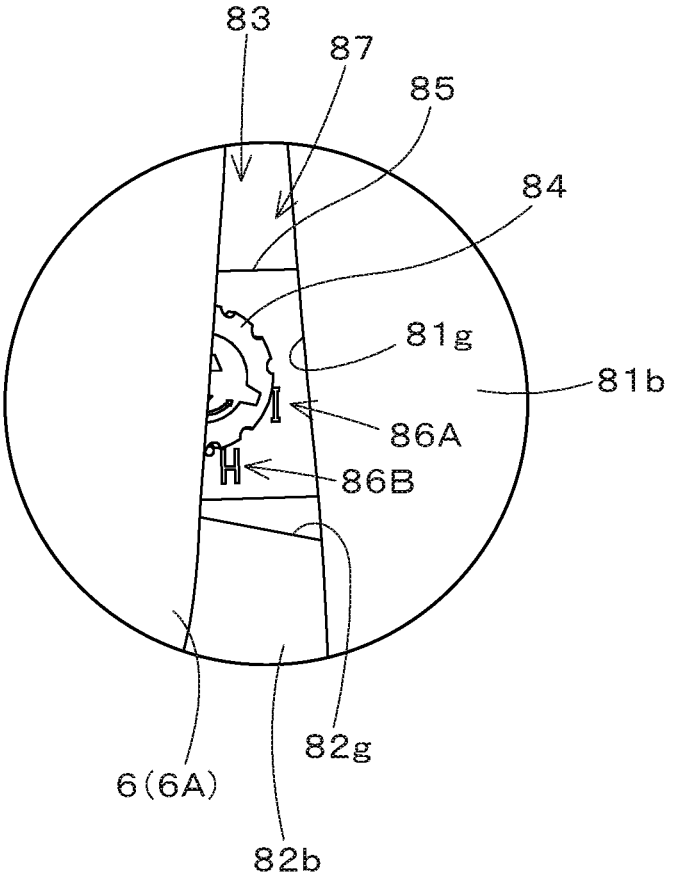
FIG. 14 is a plan perspective view illustrating another visibility state of the pattern switching member.
Figure 15:
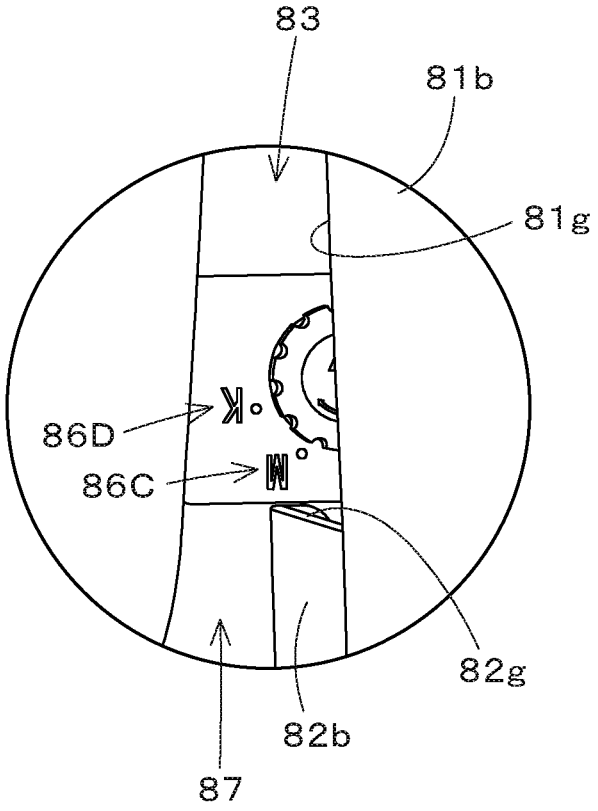
FIG. 15 is a plan perspective view illustrating another visibility state of the pattern switching member.

As illustrated in FIG. 11, the lower end of the first manipulator base 61L, when in the second position Y2, is inclined in a sloped-up-forward manner in a side view. Therefore, it is easy to access the pattern switching member 84 from ahead thereof, and it is easy to operate the pattern switching member 84 from ahead of the first manipulator base 61L. As illustrated in FIG. 13, the switching operation position of the pattern switching member 84 is visible through the clearance 87 between the operator's seat 6 and the first manipulator base 61L in a state in which the operating body 72 is in the first position Y1. That is, the pattern switching member 84 is disposed at such a position that makes the switching operation position for the plurality of manipulation patterns visible through the clearance 87 between the operator's seat 6 and the manipulator base 61 when the operating body 72 is in the first position Y1. The switching operation position of the pattern switching member 84 is visible also in a state in which the operator is seated on the operator's seat 6. Though FIG. 13 illustrates a state in which the H mark 86B and a part of the M mark 86C are visible, the other marks also will become visible by the operator's changing his/her viewpoint, from which the pattern switching member 84 is viewed, as illustrated in FIGS. 14 and 15.

As illustrated in FIG. 8, the pattern switching member 84 is located behind the front edge of the side opening portion 83 (the rear edge 82*g* of the inner sidewall 82*b*). Therefore, the switching operation position for the plurality of manipulation patterns is easily visible through the side opening portion 83. A viewing window may be provided on the manipulator base cover 70 such that the pattern switching member 84 will be visible through its see-through opening when the operating body 72 is in the first position Y1.

In a working machine 1 that electrically controls its control valves for controlling its hydraulic actuators, there exists a method of switching the manipulation pattern by means of meters disposed in front of its operator's seat 6. However, change operation using the meters is troublesome, and there is a need to display the manipulation pattern always on the screen. Another problem is that the manipulation pattern displayed on the meter is small and thus hard to view. The present embodiment provides a solution to these problems because the pattern switching member 84 has a switch structure.

Moreover, the working machine 1 described above makes it possible to change the manipulation pattern of the manipulation member 62 easily before the working machine 1 is delivered on lease by the lease service provider, and the pattern switching member 84 is located at a position that makes it possible to check the manipulation pattern of the manipulation member 62 quickly. Furthermore, the operator is able to check the manipulation pattern easily before getting on the working machine 1. In the present embodiment, in a system that electrically controls its control valves for hydraulically controlling its hydraulic actuators, a case where the manipulation pattern of the manipulation member 62 is switched by means of the switching of the pattern switching member 84 configured as a switch has been described, but not limited thereto. The disclosed technique may be applied to a case where, in a system that hydraulically controls its control valves for controlling its hydraulic actuators, the manipulation pattern of the manipulation member 62 is switched by switching a path for hydraulic fluid by the pattern switching member 84 configured as a rotary valve.

The working machine 1 described above includes: the machine body 2; the operator's seat 6 mounted on the machine body 2; the operating body 72 provided in proximity to the operator's seat 6 and switchable between the first position Y1 and the second position Y2, the first position Y1 being a position to prevent an operator from getting on and off the operator's seat 6, the second position Y2 being a position to allow the operator to get on and off the operator's seat 6; a plurality of hydraulic actuators (the swivel motor 12, the boom cylinder 32, the arm cylinder 42, and the bucket cylinder 52) whose operation is enabled when the operating body 72 is in the first position Y1 and whose operation is disabled when the operating body 72 is in the second position Y2; the manipulation member 62 to be manipulated to operate the plurality of hydraulic actuators; and the pattern switching member 84 to be operated switchingly to select one from among a plurality of manipulation patterns of the manipulation member 62 to operate the plurality of hydraulic actuators, wherein when the operating body 72 is in the first position Y1, at least a part of the pattern switching member 84 is covered by the operating body 72 so that the pattern switching member 84 is impossible or difficult to be operated, and when the operating body 72 is in the second position Y2, the pattern switching member 84 is exposed to be operable.

With this configuration, it is possible to prevent the pattern switching member 84 from being operated in a state in which the operating body 72 is in the first position Y1, although the pattern switching member 84 is operable in a state in which the operating body 72 is in the second position Y2. The working machine 1 further includes: a plurality of control valves (the swiveling control valve V1, the boom control valve V2, the arm control valve V3, and the bucket control valve V4) provided correspondingly for the plurality of hydraulic actuators and configured to hydraulically control the plurality of hydraulic actuators respectively; the detection sensor 65 configured to detect a manipulating direction and a manipulation amount of the manipulation member 62; and the controller 66 configured to acquire a detection signal from the detection sensor 65 and electrically control the control valves, wherein the pattern switching member 84 is configured as a switch that has switching operation positions corresponding to the respective manipulation patterns and sends a switching operation signal corresponding to one of switching operation positions to the controller 66, and the controller 66 includes the pattern switch 66A configured to, based on the switching operation signal sent from the pattern switching member 84, switch the manipulation pattern.

With this configuration, it is possible to make the structure of the pattern switching member 84 compact and dispose it in a compact manner. The operating body 72 includes the manipulator base 61, which is disposed beside the operator's seat 6 and on which the manipulation member 62 is mounted. The manipulator base 61 includes the manipulator base cover 70 covering the supporting structure body 69 of the manipulator base 61 and having an open-bottomed shape. When the operating body 72 is in the first position Y1, the pattern switching member 84 is located inside an area of, and closer to the lower end of, the manipulator base cover 70, and at least the top portion of the pattern switching member 84 is located above the lower end 82*c*1, 82*a*1 of the wall portion (the front wall 82*c*, the outer sidewall 82*a*) of the manipulator base cover 70 covering the front and the side of the pattern switching member 84.

With this configuration, it is possible to prevent the pattern switching member 84 from being operated when the operating body 72 is in the first position Y1. The working machine 1 further includes: the seat table 67 supporting the operator's seat 6, wherein a rear portion of the manipulator base 61 is pivotally supported by the seat table 67 such that a front portion of the manipulator base 61 is configured to move pivotally up and down, and the manipulator base 61 is configured to switch to the second position Y2 by being moved pivotally up from the first position Y1, which is closer to the seat table 67, and wherein the pattern switching member 84 is disposed on the seat table 67 under the front portion of the manipulator base 61.

With this configuration, it is possible to operate the pattern switching member 84 easily from ahead of the seat table 67 in a state in which the operating body 72 is in the second position Y2. The pattern switching member 84 having switching operation positions corresponding to the respective manipulation patterns is disposed at a position where at least one of the switching operation positions is visible through the clearance 87 between the operator's seat 6 and the manipulator base 61 when the operating body 72 is in the first position Y1. With this configuration, it is possible to check the switching operation position of the pattern switching member 84 even when the operating body 72 is in the first position Y1.

The manipulator base cover 70 has the side opening portion 83, which is open toward the operator's seat 6 and located behind a portion having a wall facing toward the operator's seat 6, and the pattern switching member 84 is located behind the front edge of the side opening portion 83 (the rear edge 82*g* of the inner sidewall 82*b*) such that the at least one of the switching operation positions corresponding to the respective manipulation patterns is visible through the side opening portion 83. This configuration further makes it easier to check the manipulation pattern when the operating body 72 is in the first position Y1.

While preferred embodiments of the present invention have been described above, it shall be construed that the embodiments disclosed herein are just illustrative in every aspect and not restrictive, and it is to be understood that variations and modifications will be apparent to those skilled in the art without departing from the scope and spirit of the present invention. All modifications made within the scope of the claims and its equivalents are intended to be encompassed herein. The scope of the present invention, therefore, is to be determined solely by the following claims.

What is claimed is:

1. A working machine, comprising:

a machine body;

a seat table installed on the machine body and including a top wall portion;

an operator's seat installed on the top wall portion of the seat table;

an operating body provided in proximity to the operator's seat and switchable between a first position and a second position, the first position being a position to prevent an operator from getting on and off the operator's seat, the second position being a position to allow the operator to get on and off the operator's seat;

a plurality of hydraulic actuators whose operation is enabled when the operating body is in the first position and whose operation is disabled when the operating body is in the second position;

a manipulation member to be manipulated to operate the plurality of hydraulic actuators; and a pattern switching member to be operated switchingly to select one from among a plurality of manipulation patterns of the manipulation member to operate the plurality of hydraulic actuators, wherein the operating body includes a manipulator base disposed beside the operator's seat, the manipulation member being mounted on the manipulator base, the pattern switching member is disposed at a position above the top wall portion and under the manipulator base, when the operating body is in the first position, at least a part of the pattern switching member is covered by the operating body so that the pattern switching member is impossible or difficult to be operated, when the operating body is in the second position, the pattern switching member is exposed to be operable, and the pattern switching member having switching operation positions corresponding to the respective manipulation patterns is disposed at a position where at least one of the switching operation positions is visible through a clearance between the operator's seat and manipulator base when viewed from above by the operator seated on the operator's seat when the operating body is in the first position.

2. The working machine according to claim 1, further comprising:

a plurality of control valves provided correspondingly for the plurality of hydraulic actuators and configured to hydraulically control the plurality of hydraulic actuators respectively;

a detection sensor configured to detect a manipulating direction and a manipulation amount of the manipulation member; and a controller configured to acquire a detection signal from the detection sensor and electrically control the control valves, wherein the pattern switching member is configured as a switch that has switching operation positions corresponding to the respective manipulation patterns and sends a switching operation signal corresponding to one of the switching operation positions to the controller, and wherein the controller includes a pattern switch configured to, based on the switching operation signal sent from the pattern switching member, switch the manipulation pattern.

3. The working machine according to claim 1, wherein a rear portion of the manipulator base is pivotally supported by the seat table such that a front portion of the manipulator base is configured to move pivotally up and down, and the manipulator base is configured to switch to the second position by being moved pivotally up from the first position, which is closer to the seat table.

4. A working machine comprising:

a machine body;

an operator's seat mounted on the machine body;

an operating body provided in proximity to the operator's seat and switchable between a first position and a second position, the first position being a position to prevent an operator from getting on and off the operator's seat, the second position being a position to allow the operator to get on and off the operator's seat;

a plurality of hydraulic actuators whose operation is enabled when the operating body is in the first position and whose operation is disabled when the operating body is in the second position;

a manipulation member to be manipulated to operate the plurality of hydraulic actuators; and a pattern switching member to be operator switchingly to select one from a among a plurality of manipulation patterns of the manipulation member to operator the plurality of hydraulic actuators, wherein when the operating body is in the first position, at least a part of the pattern switching member is covered by the operating body so that the pattern switching member is impossible or difficult to be operated, when the operating body is in the second position, the pattern switching member is exposed to be operable, the operating body includes a manipulator base disposed beside the operator's seat, the manipulation member being mounted on the manipulator base, the manipulator base includes a manipulator base cover covering a supporting structure body of the manipulator base and having an open-bottomed shape, and when the operating body is in the first position, the pattern switching member is located inside an area of, and closer to a lower end of, the manipulator base cover, and at least a top portion of the pattern switching member is located above a lower end of a wall portion of the manipulator base cover covering a front of the pattern switching member and above a lower end of a wall portion of the manipulator base cover covering a side of the pattern switching member.

5. The working machine according to claim 4, wherein the manipulator base cover has a side opening portion, which is open toward the operator's seat and located behind a portion having a wall facing toward the operator's seat, and the pattern switching member having switching operation positions corresponding to the respective manipulation patterns is located behind a front edge of the side opening portion such that at least one of the switching operation positions is visible through the side opening portion.

* * * * *